United States Patent [19]

Eaton

[11] Patent Number: 4,464,872

[45] Date of Patent: Aug. 14, 1984

[54] BUILDING PANEL

[75] Inventor: James W. Eaton, Sleepy Hollow, Ill.

[73] Assignee: Masonite Corporation, Chicago, Ill.

[21] Appl. No.: 427,543

[22] Filed: Sep. 29, 1982

[51] Int. Cl.[3] ..... E04B 1/00

[52] U.S. Cl. ..... 52/276; 52/518

[58] Field of Search ..... 52/276, 631, 277, 57, 52/313, 518

[56] References Cited

U.S. PATENT DOCUMENTS

| | | | |
|---|---|---|---|
| 1,862,627 | 6/1932 | MacLean | 52/276 |
| 2,101,589 | 11/1937 | MacLean | 20/5 |
| 2,259,962 | 10/1941 | Owen | 108/24 |
| 2,393,379 | 1/1946 | Jones | 20/5 |
| 2,532,017 | 11/1950 | Elmendorf | 20/91 |
| 2,680,267 | 6/1954 | Remstein | 20/5 |
| 2,730,969 | 1/1956 | Perry | 108/24 |
| 3,671,369 | 5/1970 | Kvalheim et al. | 52/631 X |
| 3,796,586 | 3/1974 | Hanlon et al. | 117/8 |
| 3,868,300 | 2/1975 | Wheeler | 162/124 |
| 4,279,106 | 7/1981 | Gleason et al. | 52/100 |

FOREIGN PATENT DOCUMENTS

| | | | |
|---|---|---|---|
| 2817 | 7/1979 | European Pat. Off. | 52/276 |

*Primary Examiner*—Carl D. Friedman

*Attorney, Agent, or Firm*—Mason, Kolehmainen, Rathburn & Wyss

[57] ABSTRACT

A building panel of composite wood materials adapted to cover intersecting surfaces on opposite sides of an apex at the hip or ridge of a roof or corner of a building includes a substantially flat back face and an irregular outer weather face resulting in variations in panel thickness at different positions on the panel face. The panel is provided with a V-shaped groove formed in the back face and extending along an axis adapted to overlie the apex of intersection on application of the panel on a building and also includes a V-shaped groove formed in the irregular outer weather face directly opposite the V-groove in the back face defining therebetween a panel web of substantially constant thickness between the apexes of the grooves that is less than the average nominal thickness of the panel between the faces. These grooves facilitate the bending of half portions of the panel on opposite sides of the grooves to fit against intersecting surfaces on a building roof or wall corner.

12 Claims, 13 Drawing Figures

20

BUILDING PANEL

BACKGROUND OF THE INVENTION

1. Field of the Invention

The present invention relates to man-made building panels formed of wood composite material and more particularly, relates to a building panel adapted for use along the apex of a pitched roof on the hip or ridge, or the corner of a building wall structure. The panels are formed with an outer weather surface which is deeply embossed to resemble the appearance of a typical wood shake or shingle and is especially adapted to be used along the apex of a building wall corner or along the ridge line of a roof.

2. Description of the Background Art

A variety of building panels have been provided for building sidewalls and roofs and some are man-made with an irregular outer weather surface which is embossed or shaped to resemble a typical wood shingle or shake. Panels are formed of composite wood materials and are designed to present a rustic or actual wood appearance when applied on a building roof or wall structure. U.S. Pat. No. 2,259,962 discloses a shingle adapted for finishing hips and ridges of roofs. U.S. Pat. No. 3,796,586 discloses a deep embossed shingle lap siding formed of pressed wood fibers and U.S. Pat. No. 3,868,300 discloses a composite wood panel laminate having deep indentations in an outer weather face formed with a tough, outer fibrous skin and a core of relatively softer course fibrous material therebeneath.

U.S. Pat. No. 2,532,017 discloses a panel for siding and roofs formed of wood boards with grooves on opposite faces. U.S. Pat. No. 2,730,969 discloses a hip, ridge and valley roofing shingle which employs a flexible waterproof sheeting material joined to a pair of shingle elements on opposite sides. U.S. Pat. No. 2,680,267 discloses a corner element of asphalt impregnated insulation board having an outer coating of crushed rock, ceramic granules and the like. U.S. Pat. No. 2,393,379 discloses a building element having a body of fibre-board with a V-groove therein and an outer surface of asphalt impregnated felt with granules thereon laminated to the body. U.S. Pat. No. 2,101,589 discloses a similarly constructed building corner unit and U.S. Pat. No. 4,279,106 discloses a roof panels having a hard plastic otuer shell with a body filled with foam and a plurality tabs along an upper edge formed between pairs of grooves to facilitate the break off of selected tabs when required during installation.

OBJECTS OF THE INVENTION

It is an object of the present invention to provide a new and improved building panel formed of composite wood material.

It is another object of the present invention to provide a new and improved unitary building panel formed of composite wood materials and especially adapted for application along the hip or ridge of a roof structure or the corner of a building wall structure.

Another object of the present invention is to provide a new and improved building panel of the character described which is wind and weather resistant, light in weight, aesthetically pleasing to the eye, and easy of application.

Still another object of the present invention is to provide a new and improved composite wood building panel of the character described having an outer weather surface shaped or embossed to closely resemble an individual wood shingle or shake.

Yet another object of the present invention is to provide a new and improved building panel of the character described which is formed with a pair of aligned grooves on opposite faces for facilitating the application of the panel along the apex or ridge of a roof or the corner of a building wall structure.

Yet another object of the present invention is to provide a new and improved composite wood building panel of the character described which is especially designed for universal application along building corners or roof ridge lines having angularly intersecting wall surfaces with a wide range of angles of intersection.

Still another object of the present invention is to provide a new and improved building wall panel of the character described having an irregular outer weather face and a centrally aligned web section of reduced uniform thickness defined between opposite halves of the panel to facilitate displacement of the halves along a fold axis as the halves are installed against angularly intersecting wall surfaces of a roof or corner of a building wall structure.

Still another object of the present invention is to provide a new and improved panel of the character described having a V-shaped groove formed in opposite faces thereof in direct alignment along a center portion to form a web of uniform thickness dividing the panel into opposite halves along a fold axis parallel of the grooves.

Yet another object of the present invention is to provide a grooved panel of the character described especially adapted to accommodate angular displacement of the panel halves relative to one another along a line or fold axis generally parallel of the grooves in a web formed therebetween.

Still another object of the present invention is to provide a new and improved building panel of the character described adapted for application along the apex of a roof or the corner of a building wall structure and providing a relatively smooth outer surface along an apex of intersection formed between opposite halves thereof when the halves are angularly displaced to fit a building corner or roof structure.

BRIEF SUMMARY OF THE INVENTION

The foregoing and other objects and advantages of the present invention are accomplished in a new and improved unitary building panel formed of wood composite material and especially adapted for application along the apex of a roof or corner of a building wall structure. The unitary panel includes a substantially flat back face and a deeply embossed outer weather face designed to resemble shingles or shakes of wood and resulting in variations in panel thickness at different positions over the area of the panel face. A V-shaped groove is formed in the back face of the panel extending along a central fold axis adapted to overlie the apex of intersection of a building roof or wall corner. A similar, generally smaller V-shaped groove is formed in the outer, irregular weather face directly aligned parallel and opposite the groove in the back face. The apexes of the grooves define a web of material of substantially constant or uniform thickness that is less than the average or nominal thickness of the panel to facilitate angular displacement of the panel halves along a fold axis defined in the web between the apexes of the grooves. The reduced web thickness facilitates bending along the fold axis so that opposite sides of the panel may be fit tightly up against angularly intersecting building wall or roof surfaces on a building structure. The outer V-groove provides a means for precisely controlling the web thickness and maintaining the thickness at a substantially constant chosen value along the length of the grooves. The web thickness is chosen so that the panel halves may be manually displaced from one another along the fold axis without requiring excessive force which if applied might tend to snap or break the halves completely apart from one another at the web. On the other hand, the web is thick enough that the panel halves do not tend to break apart during handling and the web is strong enough to hold the panel halves together when displaced to fit along a ridge or hip of a roof or the corner of a building. In addition, the outer V-groove helps to minimize the formation of an irregular edge or rough break line between panel halves and provides a smoother, neater appearance. The building panels are packaged and shipped to the job site in a flat configuration and the panel halves on opposite sides of the grooves are then angularly displaced along the fold axis to fit a particular building structure on which the panels are installed.

DESCRIPTION OF THE PREFERRED EMBODIMENT

Figure 1:
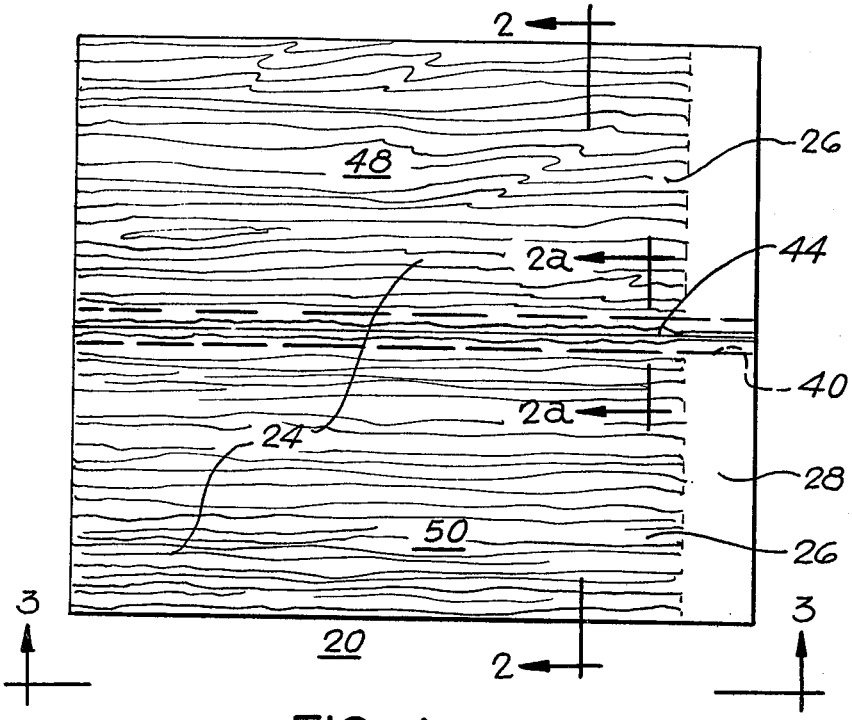
FIG. 1 is an elevational view of an outer weather face of a panel constructed in accordance with the features of the present invention and shown with the panel in a flat condition.
Figure 2:
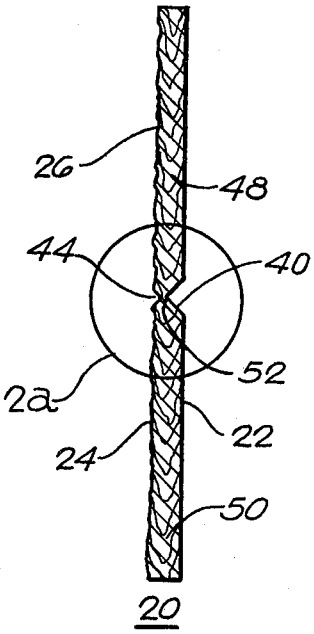
FIG. 2 is a transverse, cross-sectional view of the panel taken substantially along lines 2—2 of FIG. 1.
Figure 3:
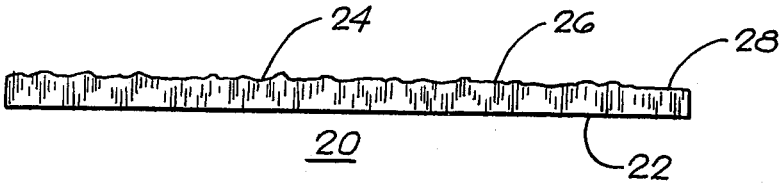
FIG. 3 is a side elevational view of the panel looking in the direction of arrows 3—3 of FIG. 1.

Referring now more particularly to the drawings and especially, FIGS. 1, 2, 2*a* and 3, therein is illustrated a new and improved building panel 20 formed of wood composite material such as flake board, chip board, hard board, plywood, etc. The material is pressed into a body of substantially uniform thickness overall in a generally rectangular shape as shown, and is formed with a relatively flat or planar back face 22. An outer or weather face 24 generally parallel of the back face is formed with a relatively large, lower segment 26 that is formed in a deep embossing process by molding under heat and pressure to provide a decorative, deeply embossed irregular surface designed to closely resembly a cedar shake or wood shingle. A relatively small outer surface portion 28 formed along an upper edge of the panel 20 is relatively flat and is adapted to underlie a lower portion of another panel 20 laid in overlapping relation therewith as illustrated in FIGS. 4, 5, 8, 9 and 10.

Figure 4:
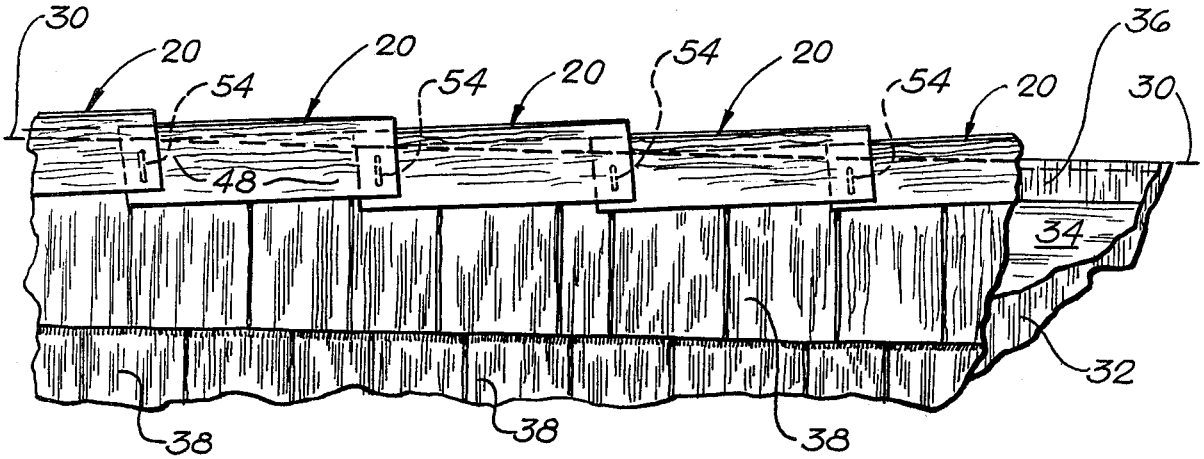
FIG. 4 is an elevational view of a pitched roof structure of a building having a plurality of panels in accordance with the present invention installed along the apex or ridge of the roof.
Figure 2A:
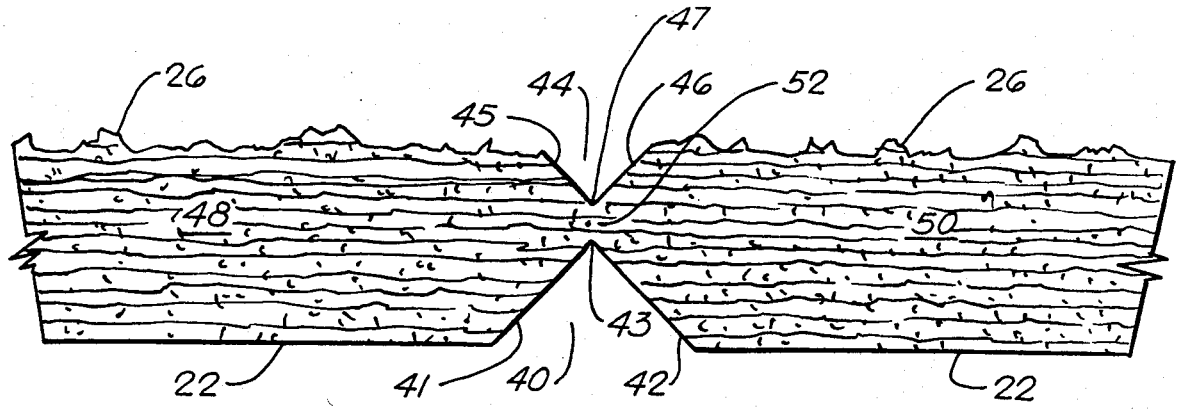
FIG. 2*a* is a fragmentary, greatly enlarged, cross-sectional view of the panel taken substantially along lines 2*a*—2*a* of FIG. 1.
Figure 6A:
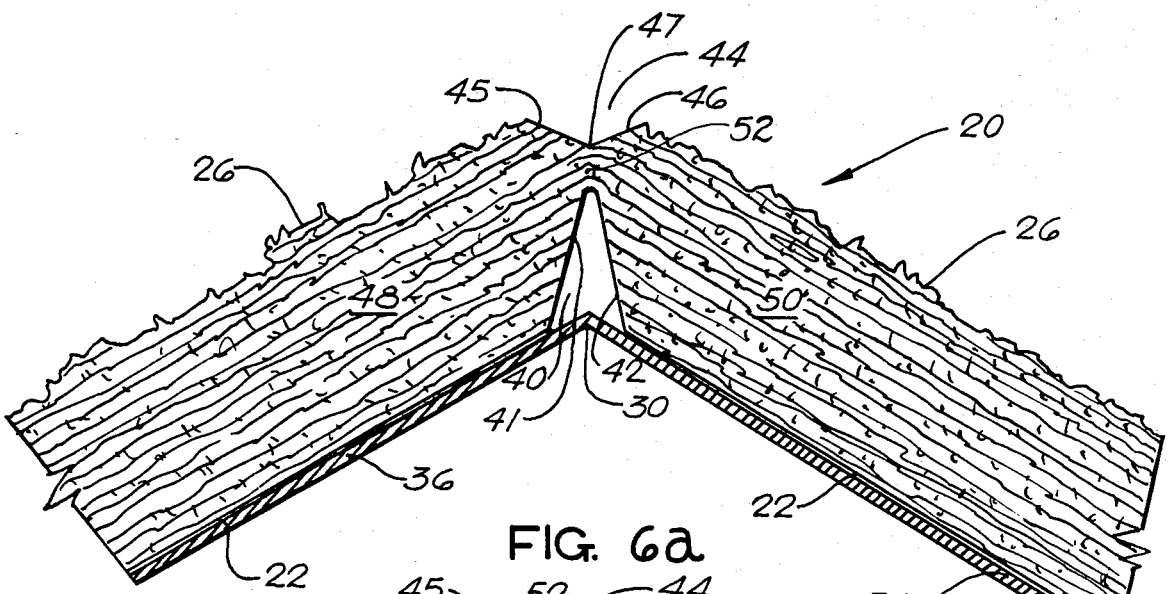
FIGS. 6, 6*a* and 6*b* are cross-sectional views of the panel taken transversely to a fold axis between opposite panel halves and showing in animated fashion how the panels are applied and installed along the apex of angularly intersecting wall and/or roof surfaces of a building structure.
Figure 6B:
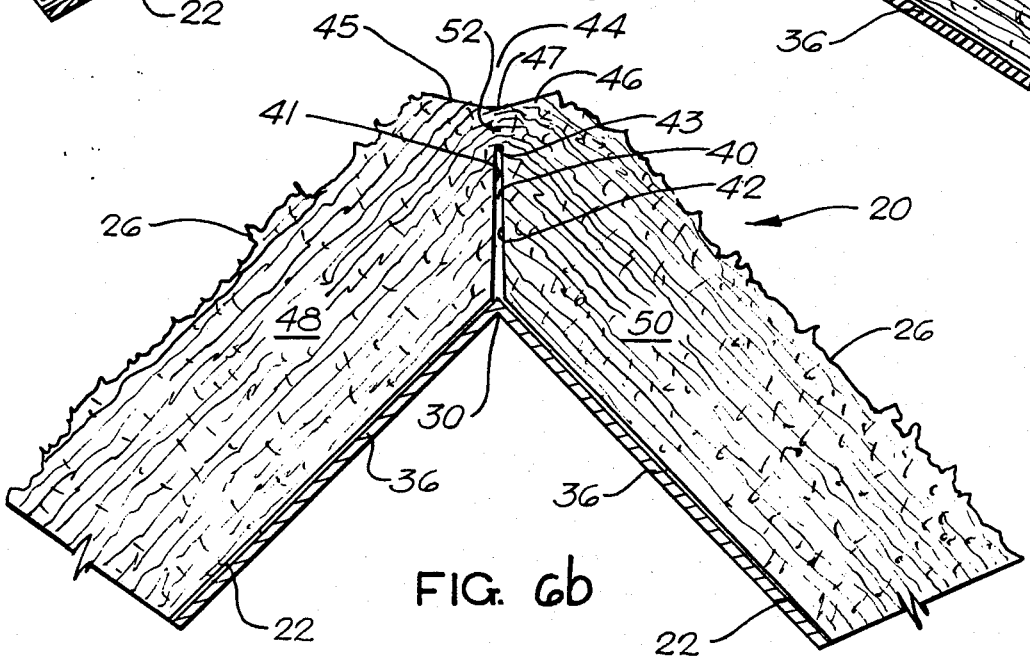
Figure 5:
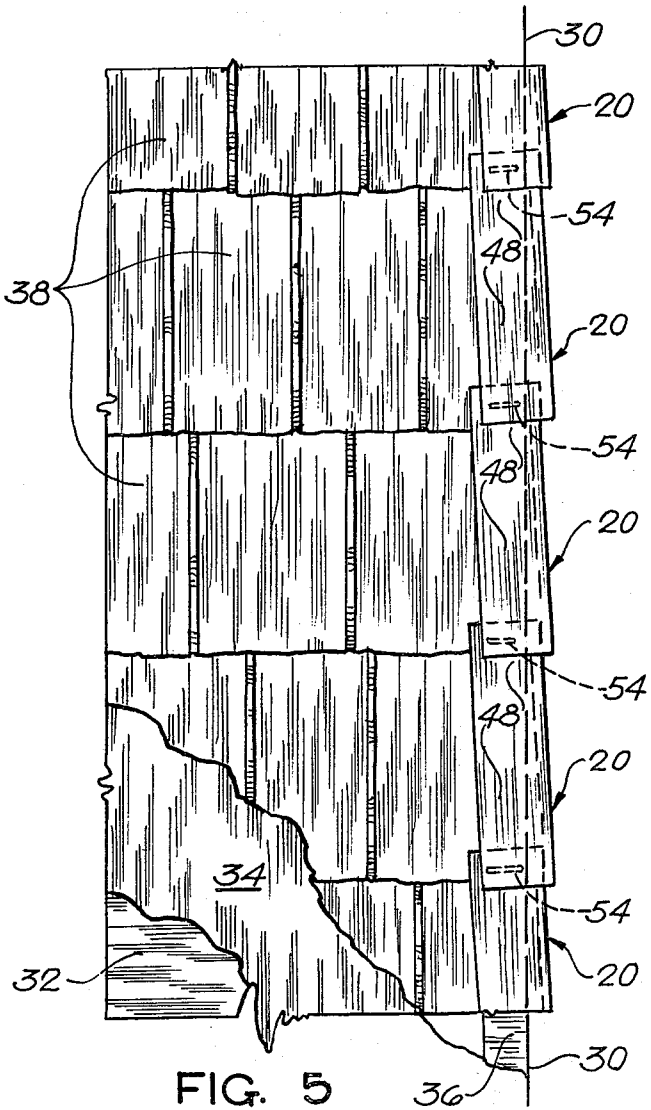
FIG. 5 is a side elevational view of a corner of a building wall structure having a plurality of panels in accordance with the present invention installed along the apex of the corner.
Figure 6:
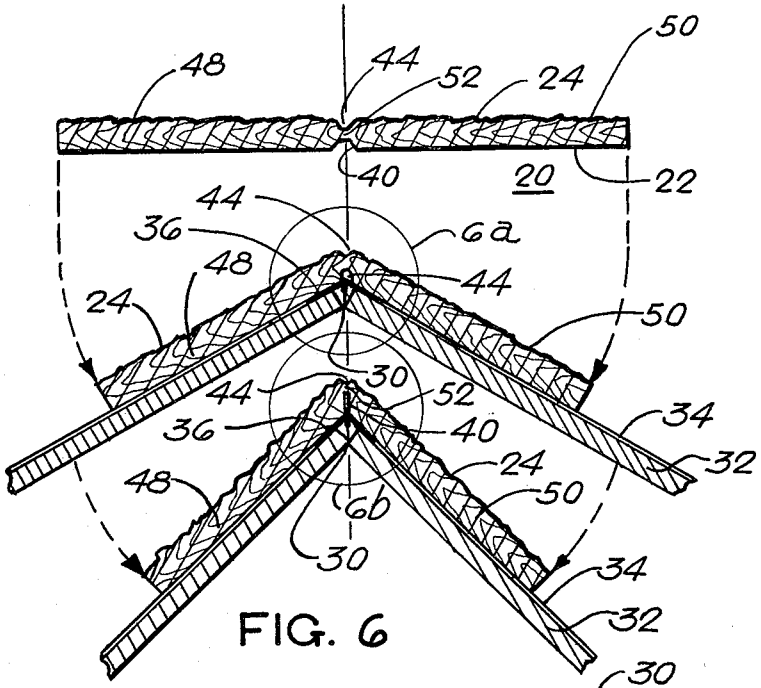
Figure 7:
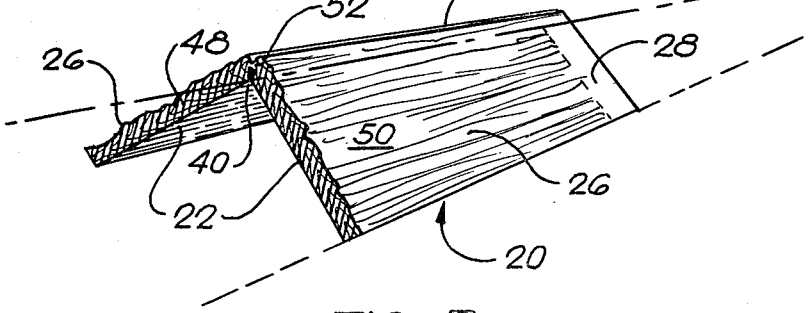
FIG. 7 is a perspective view of a building panel in accordance with the present invention with the panel halves angularly displaced and ready for application along the apex of a roof or building wall structure.
Figure 8:
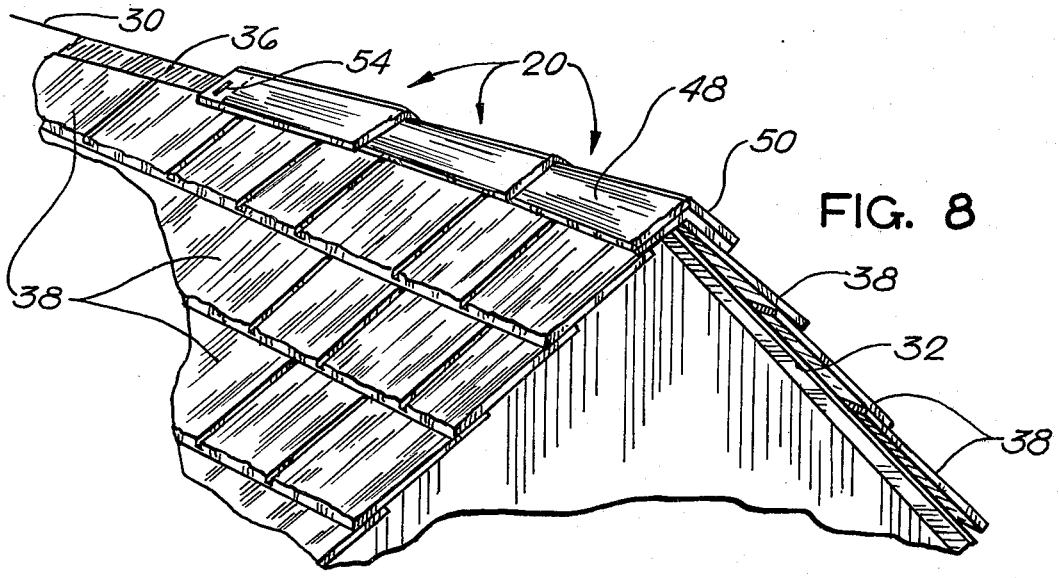
FIG. 8 is a fragmentary perspective view of a typical roof structure having new and improved building panels in accordance with the invention applied along the ridge or apex of the intersecting, sloping roof sections.
Figure 9:
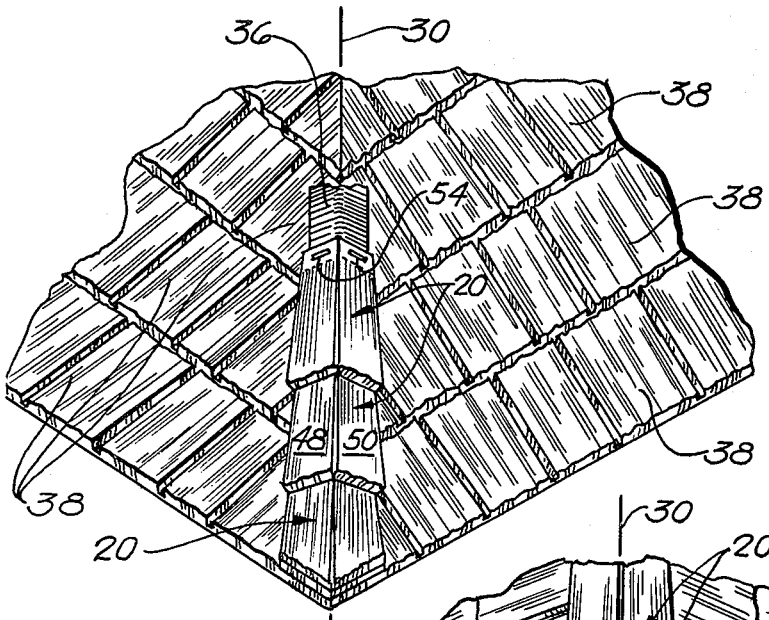
FIG. 9 is a fragmentary perspective view of a hip or corner section of a building roof structure with new and improved building panels in accordance with the present invention applied along the apex of the hip line of the roof.
Figure 10:
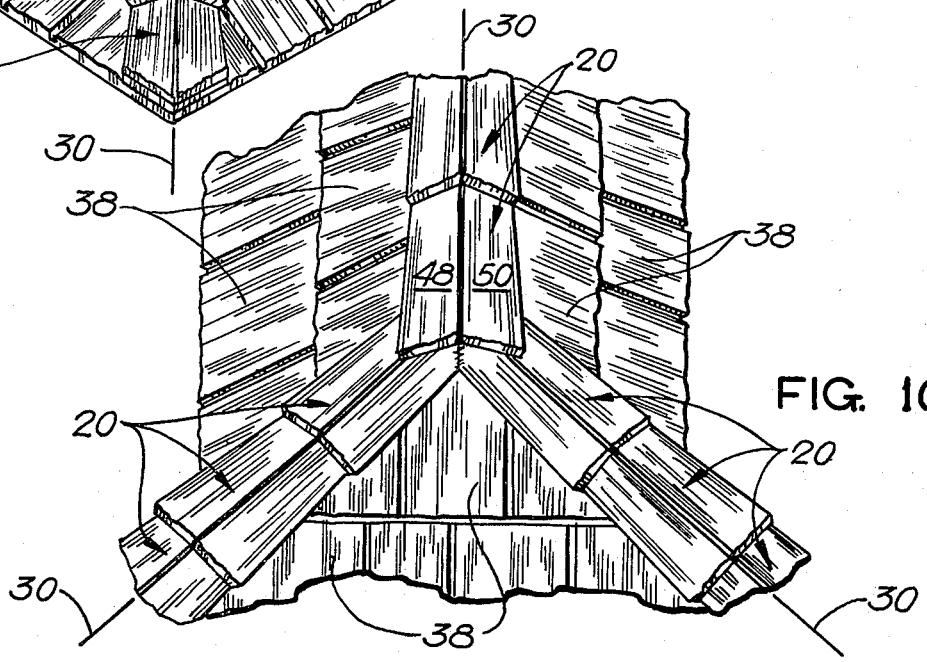
FIG. 10 is a fragmentary perspective view of a building roof structure wherein new and improved panels in accordance with the present invention are applied along a pair of intersecting hip lines of the roof and along an intersecting apex of the ridge of the roof.

The building panels 20 are especially adapted for application and installation along the apex or axis 30 at a hip or ridge line of a pitched roof structure (FIGS. 4, 6, 7, 8, 9 and 10) or along the corner of a vertical building wall structure as shown in FIG. 5. In either event, the apex or axis 30 is formed along a line of intersection between intersecting building wall or roof surfaces 32 which may slope at various angles relative to each other on opposite side of the axis as shown in FIGS. 6, 6*a*, 6*b*, 8, 9 and 10 or the intersecting wall surfaces may lie on divergent intersecting vertical planes as shown in FIG. 5.

In most cases, the building wall surfaces on opposite sides of a corner, or the hip line or ridge line of a roof are covered with a water resistant or waterproof membrane 34 such as asphalt impregnated felt or plastic films of various types. In addition as shown in FIG. 4, along the apex or axis 30, waterproof flashing 36 of metal or other water-tight sheet material is provided and opposite halves of the flashing extend in opposite directions from the apex or axis 30 and are angularly deflected to bear against the covering material 34 on the roof or wall surfaces 32.

As illustrated in FIGS. 4, 5, 8, 9 and 10, the roof or wall surfaces 32 are covered with rows of shingles 38 or siding of suitable characteristics to withstand the weather. A variety of different types and styles of siding and shingles may be used and these terminate along the apex or axis of intersection 30 at the hip or ridge line of a roof structure or at a vertical corner line of a building wall structure as shown in FIG. 5. Preferably, the outer weather face of the shingles or siding elements 38 are designed to match the appearance of the embossed, irregular, lower surface portions 26 of the building panels 20 in order to provide a rustic or natural look for the building structure.

Typically, building roof or siding panels formed of composite wood material such as those shown and described in the following copending U.S. Pat. applications Nos. 373,861; 374,166; 374,190 and 374,281; all filed on May 3, 1982, may be utilized to provide an appealing overall appearance and excellent weathering characteristics for a building wall or roof structure.

As previously indicated, the building panels 20 are generally flat or planar as initially formed and are produced in either a wet or dry process wherein composite wood materials are molded into shape under heat and pressure, and with or without separate or additional resinous binding material.

The outer weather surface portion 26 of each panel 20 is formed with deep impressions or embossments therein resulting in numerous variations in the actual thickness of the building panel at different locations over the face of the panel. For example, at a deep depression in the outer embossed face 26, the thickness of a panel may be substantially less than at a ridge or raised portion on the outer face. In a panel having a nominal thickness of 7/16", the actual panel thickness may vary from high to low as much as 3/16" and these variations are numerous and scattered over the entire panel surface 26 on a random basis that is determined by the pattern or texture on the embossing plate which is designed to closely resemble wood shingles or shakes.

In accordance with the invention, the building panel 20 is provided with an elongated, V-shaped groove 40 formed in the back face 22 to extend transversely between an upper edge of the panel and a lower edge. The groove is positioned to run along a center line or central portion of the panel between opposite side edges and divides the panel into opposite halves 48 and 50 of roughly equal surface area.

As illustrated best in FIGS. *2a, 6a* and *6b,* each V-groove 40 has a pair of substantially flat or planar sides 41 and 42 sloping inwardly toward one another from the back face 22 to intersect at an apex 43 at an angle slightly greater than the maximum angle of intersection between building roof or wall surfaces. In most applications, the angle between the groove sides 41 and 42 is a little greater than a right angle. Preferably, the groove 40 is formed by a rotating cutter of a shaper, router or milling machine and accordingly, accurate control of the depth and precise position of the groove is readily obtainable. With a cut or machined groove that is formed subsequent to the initial molding or embossing process, the composite wood material closely adjacent the groove is not subjected to excessively high molding pressures which might result in great variations in material density and brittleness that otherwise might occur if the groove was formed by molding or embossing during the initial process of forming the building panel under heat and pressure.

In accordance with the invention, directly opposite the back side groove 40, there is provided a smaller, V-shaped, outside groove 44 also extending between the upper and lower edges of the building panel. The outside groove is cut or machined in the outer weather surface 24 of the panel with a suitable cutting implement and is preferably formed at the same time that the back side groove is cut. Both grooves should be referenced from the same face, preferably the back face of the panels. In this manner, the web thickness between the opposite grooves can be precisely controlled. The groove 44 also includes substantially flat opposite sides or faces 45 and 46 which intersect at an apex 47 parallel of the apex 43 of the groove 40. The groove sides slope downwardly and inwardly toward the apex from the embossed outer surface 26 and may slope at an angle of 45° with respect to the back face 22.

The respective inner and outer grooves 40 and 44 are symetrically aligned on a plane normal to the back face of the panels 20 to extend along the center and divide the panel into the halves 48 and 50 which are preferably of substantially equal surface area. The panel halves are adapted to be angularly deflected relative to one another along a fold axis which is parallel and directly between the apexes 43 and 47 of the opposed grooves 40 and 44. The panel halves are manually pivoted about the fold axis so that the angle of deflection may precisely match and fit the angle of intersection of the surfaces 32 along the apex 30 of a building wall or roof structure.

In a building panel 20 in accordance with the present invention formed of hardboard having a nominal 7/16" thickness, a minimum web thickness between the apexes 43 and 47 of the V-grooves of 0.060" has produced satisfactory results. The web thickness can vary somewhat depending on the type of material involved and web thicknesses ranging from 0.050" to 0.070" in hardboard panels of nominal 7/16" thickness may produce satisfactory results.

If the web thickness is too great, excessive bending force is required to fit the panel halves against the building surfaces and when excessive force is required, the panel halves may be broken completely apart or snapped off and separated completely along the grooves. On the other hand if the web thickness is too small, the panel halves may break apart inadvertently when a bend is made or even during handling before installation on a building wall.

The back face groove 40 and the outer face groove 44 precisely define therebetween a web 52 of reduced thickness having a minimum thickness at the center of the panel between the apexes of the grooves and of the panel halves. The web extends transversely between the upper and lower edges of the panel. The web thickness is thus precisely dimensioned and is uniform along the length entire of the opposing grooves even though the face 26 is deeply embossed and irregular in shape. Because the web portion is of uniform and reduced thickness, manual angular adjustment panel halves 48 and 50 does not require excessive force which might result in a complete severance during the installation process. The reduced web thickness requires a smaller bending force so that the panel halves may be fitted more easily and precisely against any angularly intersecting building wall or roof surfaces 32 that may be encountered.

Because the grooves 40 and 44 are cut or machined after the initial formation of the building panels 20, the composite wood material in the web 52 between the panel halves 48 and 50 is substantially uniform in density and is not substantially different or more brittle than that of the materials in other portions of the panel halves more distant from the grooves. Because of this uniform density and lack of brittleness, the panel halves can be readily manipulated and bent along a fold axis in the web portion parallel of the grooves. In normal usage, the panel halves are bent along the fold axis only one time and this bending of the panel halves 48 and 50 relative to one another along the web 52 does not usually result in a complete breakage or separation of the panel halves into two physically separate parts. When the bending or angular manipulation of the panel halves is done properly with care and is not repeated or reversed by bending the panel halves back and forth several times, the web 52 normally stays entact and unsevered.

As illustrated in FIGS. *2a, 6, 6a,* and *6b* the amount of angular displacement between panel halves 48 and 50 may vary greatly depending upon a particular building installation. In most applications, the outer groove surfaces 45 and 46 provide a smooth rather than a ragged or broken edge surface and the result is a much neater and cleaner appearance along a ridge or corner.

If, however, during application, the panel halves 48 and 50 break apart and the thin web 52 fractures, a continuous break or division between the panel halves is not disastrous because normally the flashing 36 along the corner, hip or ridge prevents water leakage or penetration into the interior of the building wall or roof structure. When a break occurs, it is usually clean and does not detract asthetically.

The building panels 20 are thus, easily applied and are particularly designed to overlap one another along the hip, ridge or corner line of a building structure. The panels can accommodate a wide range of angular displacement between adjacent intersecting building surfaces along a roof hip or ridge line or a vertical wall corner. The panels are laid up in overlapping relation as indicated and are secured in place with staples 54 or other suitable fasteners which are normally driven in place by a power fastener driving gun. The precisely spaced inner and outer grooves 40 and 44 on the respective back face and outer face of the building panels 20 permit the use of a deeply embossed pattern forming an irregular outer weather face, yet bending action along a fold axis between the grooves is facilitated by the reduced thickness of the web 52. The web portion is substantially uniform in thickness along the length of the groove apexes 43 and 47 between the panel halves 48 and 50 regardless of the fact that there are numerous variations in panel thickness because of the deep embossed pattern on the outer face. The uniform web thickness provides a constant or level resistance to bending as physical force is applied to displace the panel halves to fit against a building. Variations in the panel thickness at different surface points as illustrated in FIGS. *2a*, *6a* and *6b* are readily accommodated without resulting variations in the thickness of the web 52 and a much lower incidence of complete fracture or breakage along the grooves between the panels halves 48 and 50 is encountered.

Although the present invention has been described with reference to a single illustrated embodiment thereof, it should be understood that numerous other modifications and embodiments can be made by those skilled in the art that will fall within the spirit and scope of the principles of this invention.

What is claimed as new and is desired to be secured by Letters Patent is:

1. A rectangular building panel adapted to cover intersecting surfaces on opposite sides of an apex of intersection;

said panel formed of composite wood fibre materials having a substantially flat back face and an outer face having a narrow flat portion along one longitudinal edge designed to underlie the back face of a panel in a next course and a substantially larger portion adapted for exposure to the weather having an irregular surface resulting in variations in panel thickness at different locations on said panel faces, said irregular surface being deeply embossed to resemble a pair of shingle-like elements disposed on opposite sides of an axis normal to said longitudinal edge generally bisecting said panel, said panel having a generally V-shaped groove formed in said back face extending along said axis and adapted to overlie said apex of intersection on the application of said panel against said intersecting surfaces of a building, said panel having a generally V-shaped groove formed in said outer irregular face between said shingle-like elements directly opposite and parallel of said groove in said back face, said grooves defining a web of said panel of substantially constant thickness between the apexes of said grooves, said web having a thickness substantially less than the average thickness of said panel between said faces for facilitating the angular displacement of said shingle-like elements on opposite sides of said grooves along a fold axis defined along said web to fit said opposite sides against said intersecting surfaces of said building.

2. The building panel of claim 1 wherein said grooves are formed by the removal of material from the body of said panel.

3. The building panel of claim 1 or 2 wherein said grooves are formed with substantially flat opposite sides.

4. The building panel of claim 3 wherein said flat opposite sides of each groove intersect at said web.

5. The building panel of claim 4 wherein said fold axis is defined between apexes of said opposite grooves.

6. The building panel of claim 3 wherein said flat opposite sides of said grooves are substantially normal to one another.

7. The building panel of claim 1 or 2 wherein said groove in said back face is deeper than said groove in said irregular outer face.

8. The building panel of claim 1 or 2 wherein said groove in said back face has opposite sides sloping inwardly into the body of said panel.

9. The building panel of claim 1 or 2 wherein said groove in said outer face has opposite sides sloping inwardly into the body of said panel.

10. The building panel of claim 1 or 2 wherein said web has a minimum thickness defined between apexes of said grooves.

11. The building panel of claim 1 or 2 formed of hardboard having a nominal thickness of 7/16" wherein said web has a thickness of approximately 0.060" between apexes of said grooves.

12. The building panel of claim 11 wherein said web has a thickness in the range of 0.050" to 0.070" between said apexes of said grooves.

* * * * *